US010010768B2

(12) United States Patent
Mizutani et al.

(10) Patent No.: US 10,010,768 B2
(45) **Date of Patent: *Jul. 3, 2018**

(54) GOLF CLUB

(71) Applicant: DUNLOP SPORTS CO. LTD., Kobe-shi, Hyogo (JP)

(72) Inventors: Naruhiro Mizutani, Kobe (JP); Kiyofumi Matsunaga, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/029,923

(22) PCT Filed: Oct. 10, 2014

(86) PCT No.: PCT/JP2014/077150

§ 371 (c)(1),
(2) Date: Apr. 15, 2016

(87) PCT Pub. No.: WO2015/056643

PCT Pub. Date: Apr. 23, 2015

(65) Prior Publication Data

US 2016/0228749 A1 Aug. 11, 2016

(30) Foreign Application Priority Data

Oct. 17, 2013 (JP) ..... 2013-216611

(51) Int. Cl.
*A63B 53/02* (2015.01)
*A63B 53/06* (2015.01)
(Continued)

(52) U.S. Cl.
CPC ..... *A63B 53/02* (2013.01); *A63B 53/04* (2013.01); *A63B 53/0466* (2013.01);
(Continued)

(58) Field of Classification Search
CPC ..... A63B 53/02; A63B 53/04; A63B 53/0466; A63B 2071/0694; A63B 2053/027;
(Continued)

(56) References Cited

U.S. PATENT DOCUMENTS

2010/0069170 A1 3/2010 Bennett et al.
2010/0197423 A1 8/2010 Thomas et al.
(Continued)

FOREIGN PATENT DOCUMENTS

CN 102527005 A 7/2012
CN 102574006 A 7/2012
(Continued)

OTHER PUBLICATIONS

Chinese Office Action and Search Report, dated Jun. 28, 2017, for Chinese Application No. 201480054926.7, with English translation.
(Continued)

*Primary Examiner* — Stephen Blau
(74) *Attorney, Agent, or Firm* — Birch, Stewart, Kolasch & Birch, LLP

(57) ABSTRACT

Provided is a golf club enabling the rotation position of an adapter to be viewed without disassembling a coupling structure for coupling a shaft and a golf club head. This golf club includes a shaft, a golf club head having a hosel portion, a first adapter that is accommodated in the interior space of the hosel portion through a shaft attachment hole in the hosel portion, a second adapter that has a through-hole through which the first adapter passes, and at least a portion arranged outside the attachment hole, and a fixing member detachably fixing the first adapter in the interior space of the hosel portion. The shaft is coupled with an inclination relative to the first adapter, the first adapter is coupled with an inclination relative to the second adapter, and the first adapter and the second adapter are coupled so as to be capable of axial rotation.

14 Claims, 16 Drawing Sheets

(51) Int. Cl.
*A63B 53/04* (2015.01)
*A63B 71/06* (2006.01)

(52) U.S. Cl.
CPC ... *A63B 2053/023* (2013.01); *A63B 2053/027* (2013.01); *A63B 2071/0694* (2013.01)

(58) Field of Classification Search
CPC ..... A63B 2053/023; A63B 2053/025; A63B 2053/026
See application file for complete search history.

(56) References Cited

U.S. PATENT DOCUMENTS

2012/0034995 A1* 2/2012 Harvell ..... A63B 53/02 473/307
2012/0071258 A1* 3/2012 Yamaguchi ..... A63B 53/00 473/287
2012/0100926 A1* 4/2012 Golden ..... A63B 53/02 473/307
2012/0165111 A1 6/2012 Cheng
2012/0225731 A1 9/2012 Suwa et al.
2013/0102405 A1* 4/2013 Moore ..... A63B 53/02 473/246

FOREIGN PATENT DOCUMENTS

JP 2011-062523 A 3/2011
JP 2013-500059 A 1/2013

OTHER PUBLICATIONS

International Search Report issued in PCT/JP2014/077150 dated Jan. 13, 2015.
Written Opinion of the Internaitonal Searching Authority issued in PCT/JP2014/077150 dated Jan. 13, 2015.
Chinese Office Action and Search Report, dated Apr. 3, 2018, for Chinese Application No. 201480054926.7, with an English translation.
Japanese Notification of Reasons for Refusal, dated Apr. 3, 2018, for Japanese Application No. 2015-542599. with an English translation.

* cited by examiner

GOLF CLUB

TECHNICAL FIELD

The present invention relates to a golf club.

BACKGROUND ART

Various methods of coupling a golf club head and a shaft have been proposed in recent years. For example, Patent Literature 1 discloses a golf club in which two adapters are attached between the hosel portion of the golf club head and the shaft so as to make it possible to change the angle of attachment of the shaft to the golf club head. Specifically, it has the following configuration. First, a shaft adapter attached to the shaft is fixed so as to be inclined relative to the shaft. A head adapter attached to the hosel portion is removably attached to the head at one of multiple rotation positions. The shaft adapter is then fitted into the head adapter at an inclined angle relative thereto, and furthermore can be fitted therein at multiple rotation positions. Accordingly, the shaft can be attached to the golf club head at various angles by adjusting the rotation position of the head adapter relative to the hosel portion and the rotation position of the shaft adapter relative to the head adapter. This makes it possible to adjust the lie angle, loft angle, and face angle of the golf club to suit the user's preference.

CITATION LIST

Patent Literature

Patent Literature 1: JP 2013-500059A

SUMMARY OF INVENTION

Technical Problem

However, with the above-described golf club, the shaft adapter is accommodated in the interior space of the hosel portion, and therefore the rotation position at which the head adapter is attached to the hosel portion cannot be viewed from the outside. For this reason, there is a problem in that the user therefore needs to detach and disassemble the two adapters in order to check the rotation position of the head adapter, and this task is troublesome.

The present invention has been achieved in order to solve the above problem, and an object thereof is to provide a golf club that enables the rotation position of an adapter to be viewed without disassembling a coupling structure for coupling a shaft and a golf club head.

Solution to Problem

A golf club according to the present invention includes: a shaft; a golf club head having a hosel portion and an opening portion that is formed on a side opposite to the hosel portion and is in communication with an interior space of the hosel portion, the interior space being open at a shaft attachment hole of the hosel portion; a first adapter that has a first end portion and a second end portion, the first adapter having a shaft receiving recessed portion to which the shaft is to be fixed and that is open on a side of the first end portion, and a coupling portion on the first end portion, and the second end portion being accommodated in the interior space of the hosel portion through the attachment hole; a second adapter that has a first end portion and a second end portion, a through-hole through which the first adapter passes being formed in the second adapter, and at least a portion of the second adapter being arranged outside the attachment hole; and a fixing member that detachably fixes the first adapter in the interior space of the hosel portion, wherein the shaft is configured to be coupled with an inclination relative to the coupling portion of the first adapter, the first adapter is configured to be coupled with an inclination relative to the second adapter, the coupling portion of the first adapter and the first end portion of the second adapter are coupled so as to be capable of axial rotation, and the first adapter is fixed in the interior space of the hosel portion so as to be incapable of rotation.

Note that the term "coupled" is used for the relationship between the adapters and the relationship between an adapter and the hosel in this description of the invention. The term "coupled" is intended to merely mean that at least two things are in contact so as to be immobile, and there are cases where it is not required that the two things do not separate even when external force is applied. Accordingly, besides the term "coupled", the term "engaged" is also sometimes used to express this state.

In the above golf club, the first adapter may have the first end portion and the second end portion at respective ends along a first axis and be formed with a tubular shape along the first axis, and the shaft receiving recessed portion may extend along a second axis that intersects the first axis, and the second adapter may have the first end portion and the second end portion at respective ends along a first axis and be formed with a tubular shape along the first axis, and the through-hole may be formed along a second axis that intersects the first axis.

In the above golf club, the second adapter may be formed with a ring shape, and be arranged along the attachment hole such that at least a portion of the second adapter is exposed to the outside.

In the above golf club, the coupling portion of the first adapter may be formed by a flange portion that projects radially outward, and the flange portion may be coupled to the first end portion of the second adapter.

The above golf club may further include a fixing adapter that couples the first adapter in the interior space of the hosel portion so as to be incapable of rotation.

In the above golf club, the fixing adapter and the first adapter may be splined together.

In the above golf club, an indicator indicating a rotation position may be provided on at least two out of the first adapter, the second adapter, and the attachment hole.

Advantageous Effects of Invention

With the golf club according to the present invention, the coupling portion of the first adapter and the first end portion of the second adapter are coupled outside the attachment hole of the hosel portion, and therefore the coupling state of these two adapters is visible from the outside. For this reason, the rotation positions of the adapters can be viewed without disassembling the coupling structure for coupling the shaft and the golf club head, and as a result, it is possible to check the lie angle, the loft angle, the face angle, and the like of the golf club even in the coupling state.

DESCRIPTION OF EMBODIMENTS

Figure 1:
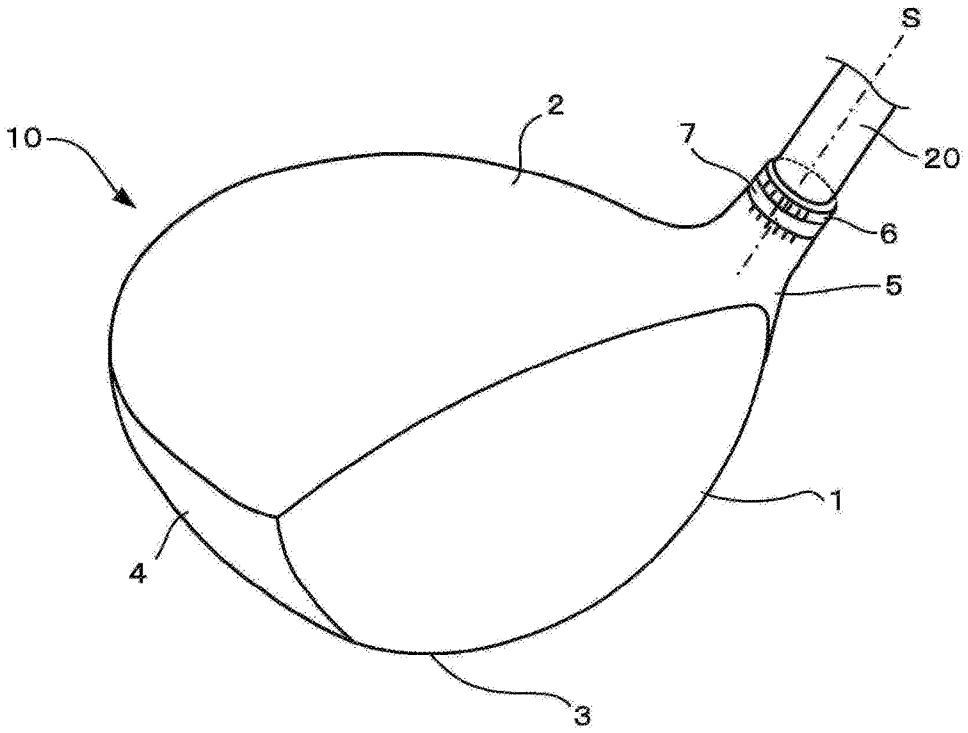
FIG. 1 is a perspective view of a golf club according to an embodiment of the present invention.
Figure 2:
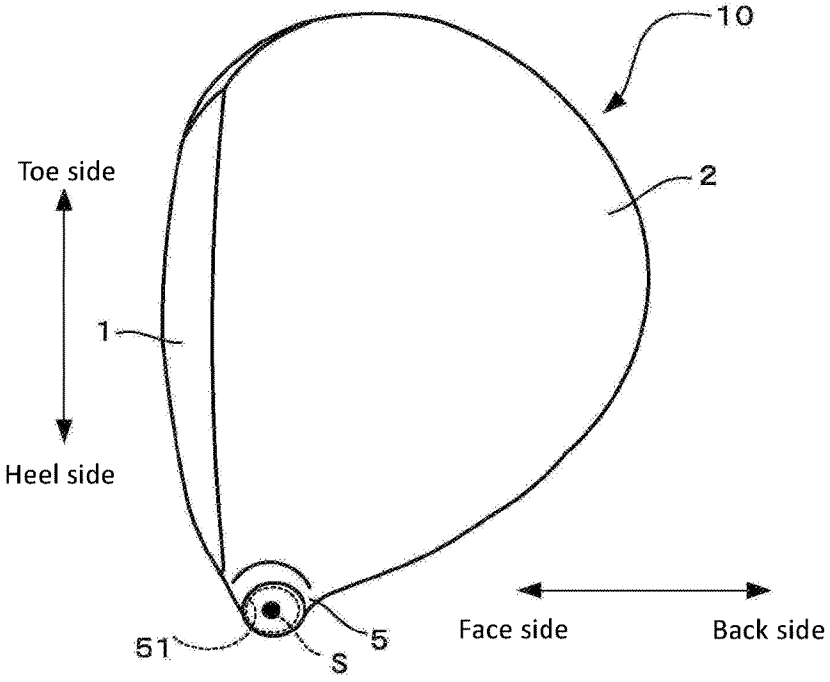
FIG. 2 is a plan view of FIG. 1.

An embodiment of a golf club according to the present invention will be described below with reference to the drawings. FIG. 1 is a perspective view of a golf club head according to the present embodiment, and FIG. 2 is a plan view of FIG. 1. Although the following description uses the orientation shown in the drawings as a reference, this is for the sake of convenience in the description, and this orientation is not intended to limit the invention. Also, the axial direction in the following description is generally the direction in which the shaft extends unless otherwise stated, and is not intended to have a strict definition.

1. Overall Structure of Golf Club

As shown in FIGS. 1 and 2, the golf club of the present embodiment includes a shaft 20 and a golf club head 10 (sometimes referred to hereinafter as simply the "head") coupled to an end portion of the shaft 20. Also, the shaft 20 and the golf club head 10 are coupled together by a later-described coupling structure, and are configured such that it is possible to change the axial rotation position of the shaft 20 relative to the head 10. These members will be described in detail below.

The shaft 20 is shaped as a hollow tube, has a lower end portion to which the above-mentioned golf club head 10 is coupled, and has an upper end portion to which a grip (not shown) is fixed.

The golf club head 10 is a hollow structure and has wall surfaces formed by a face portion 1, a crown portion 2, a sole portion 3, a side portion 4, and a hosel portion 5. The face portion 1 has a face surface, which is the surface for hitting a ball, and the crown portion 2 is adjacent to the face portion 1 and constitutes the upper surface of the head. The sole portion 3 constitutes the bottom surface of the head 10, and is adjacent to the face portion 1 and the side portion 4. Also, the side portion 4 is the portion between the crown portion 2 and the sole portion 3, and extends from the toe side of the face portion 1, across the back side of the head 10, to the heel side of the face portion 1. Furthermore, the hosel portion 5 is a cylindrical portion provided adjacent to the heel side of the crown portion 2, and has an attachment hole 51 for the insertion of a later-described first adapter 6. Note that although the head 10 described here is a wood head such as a driver (#1) or fairway wood head, it is not limited to being a wood head, and may be a so-called utility head, hybrid head, or the like.

2. Coupling Structure for Coupling Shaft and Golf Club Head

Figure 3:
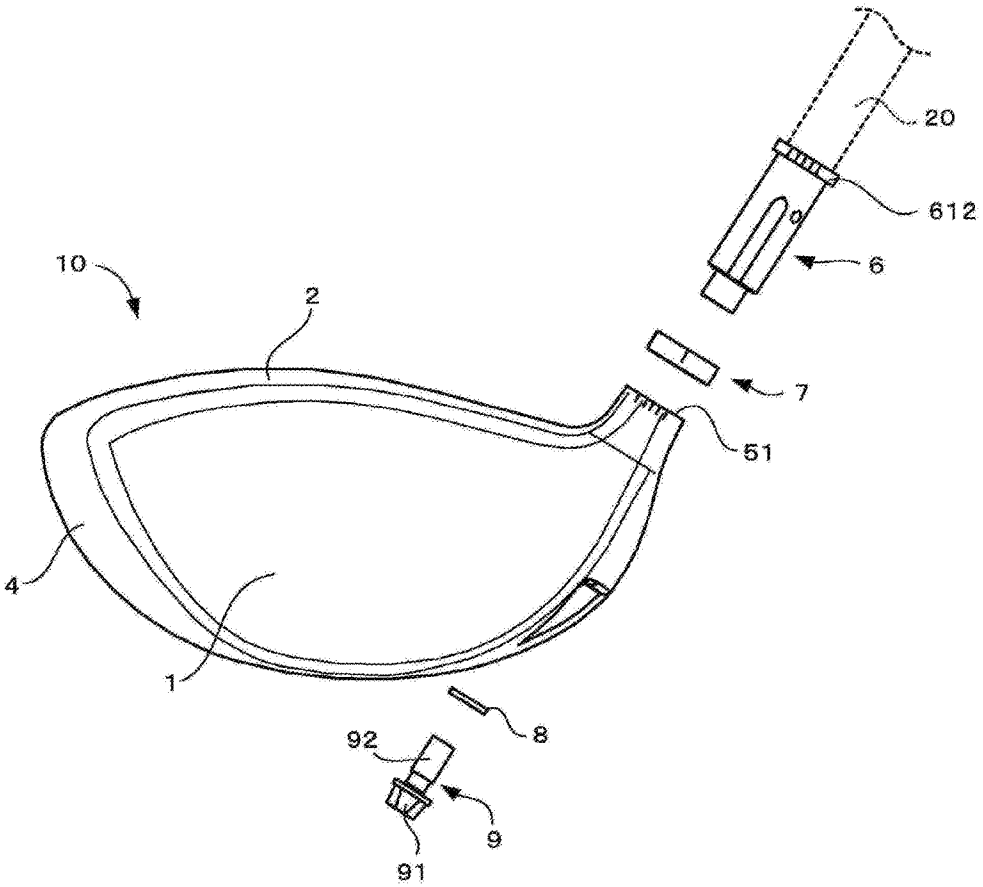
FIG. 3 is an exploded view of a coupling structure.

Next, a coupling structure for coupling the shaft 20 and the golf club head 10 will be described. FIG. 3 is an exploded view of the coupling structure. As shown in this figure, in this coupling structure, the shaft 20 and the golf club head 10 are coupled via the first adapter 6 and a second adapter 7, and these two adapters 6 and 7 are fixed to the golf club head 10 by a washer 8 and a fastener 9. This coupling structure will be described in detail below.

2.1 Coupling-Related Structure of Golf Club Head

Figure 4:
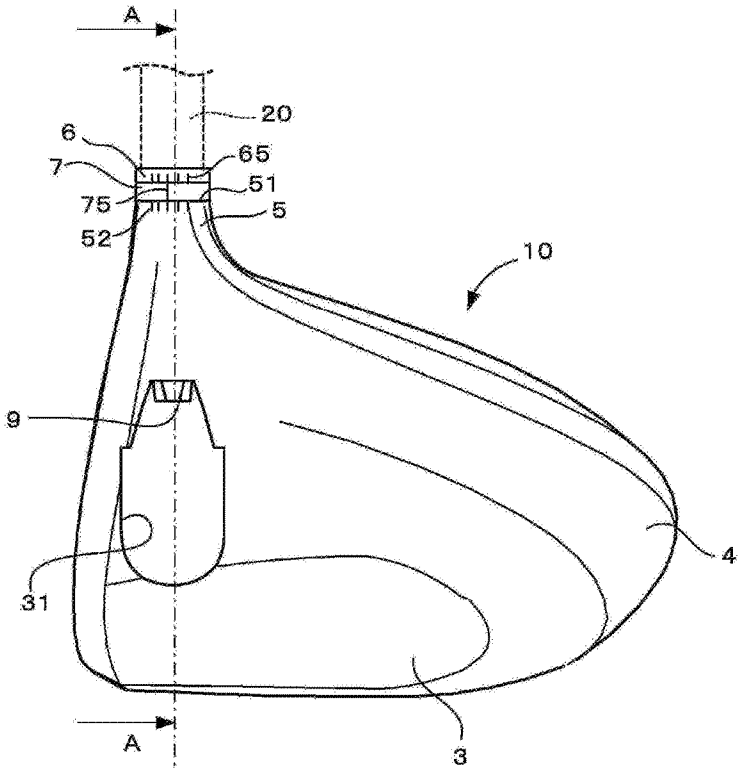
FIG. 4 is a front view of a golf club head with two adapters, a washer, and a fastener mounted therein, as viewed from the heel side.

First, the structure of the golf club head 10 will be described with reference to FIGS. 4 to 6 as well. FIG. 4 is a front view of the golf club head 10 with the two adapters 6 and 7, a washer 8, and a fastener 9 mounted therein, as viewed from the heel side, FIG. 5 is a cross-sectional view taken along line A-A in FIG. 4, FIG. 6 is a bottom view of the golf club head in FIG. 4 as viewed from the sole portion side, and FIG. 7 is a cross-sectional view of an interior space of the hosel portion.

Figure 5:
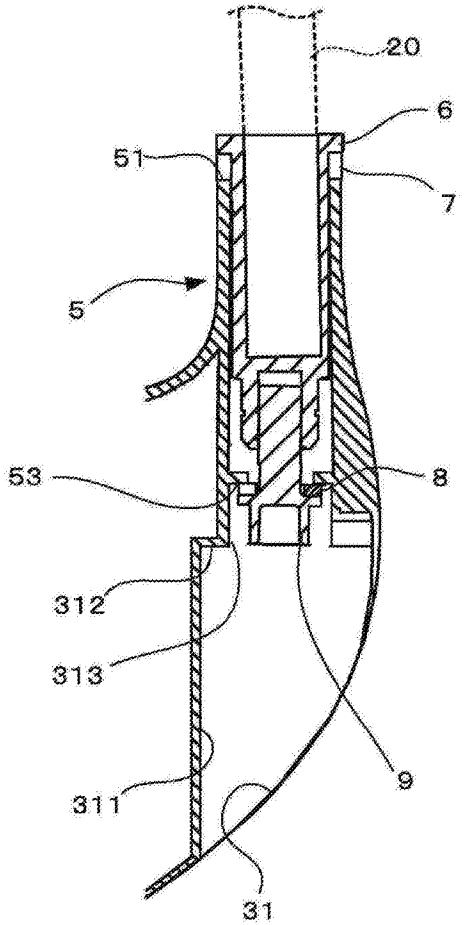
FIG. 5 is a cross-sectional view taken along line A-A in FIG. 4.
Figure 6:
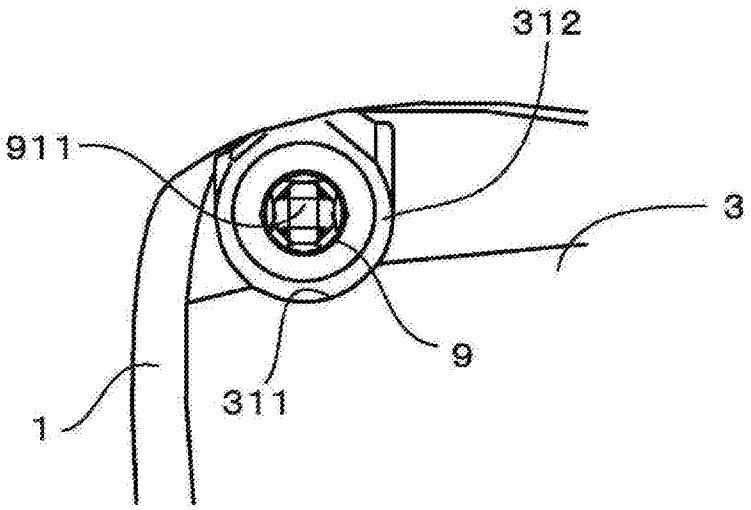
FIG. 6 is a bottom view of the golf club head in FIG. 4 as viewed from the sole portion side.

As shown in FIGS. 4 to 6, the interior space of the hosel portion 5 extends from an attachment hole 51 toward the side portion 4 side and the sole portion 3 side in a direction generally parallel to an axial direction S of the shaft 20. As will be described later, rotation position indicators 52 for alignment with the second adapter 7 are provided on the outer peripheral edge of the attachment hole 51. On the other hand, a recessed portion 31 is formed in a portion of the sole portion 3 on the side opposite to the hosel portion 5. This recessed portion 31 is constituted by an arc-shaped side surface 311 that extends substantially parallel to the interior space, and a base surface 312 that extends generally perpendicularly from the side surface 311. Also, a lower opening 313 in communication with the interior space is formed in the base surface 312.

Figure 7:
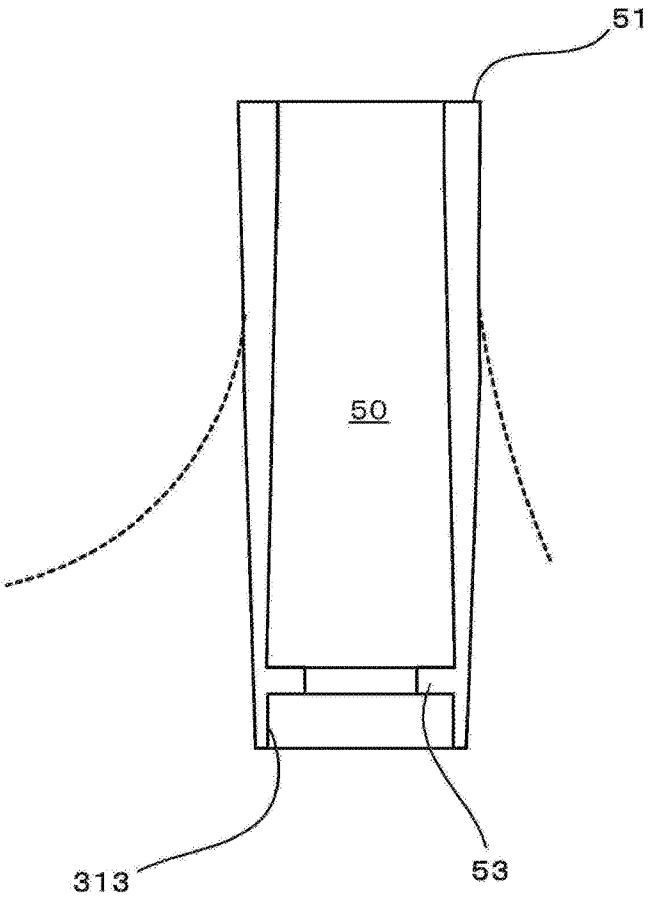
FIG. 7 is a cross-sectional view of the interior space of a hosel portion.

As shown in FIG. 7, an interior space 50 of the hosel portion 5 is formed with a cylindrical shape, the upper portion thereof constitutes the attachment hole 51 of the shaft 20, and the lower portion thereof constitutes the above-described lower opening 313. The inner wall surface of the interior space 50 is formed with a tapered shape in which the diameter somewhat increases as it extends from above to below. An annular projection portion 53 that projects radially inward is formed on the inner wall surface of the lower opening 313, and the later-described fastener 9 is attached to this projection portion 53. At the time of assembly, after the second adapter 7 has been attached to the attachment hole 51 side, the first adapter 6 is inserted so as to pass through the second adapter 7. The washer 8 and the screw-like fastener 9 are used to fix the first adapter 6 to the above-described projection portion 53 in the interior space 50. As shown in FIG. 3, the fastener 9 is formed by a head portion 91 and a threaded portion 92 coupled thereto, and a rectangular recessed portion 911 (see FIGS. 5 and 6) for the insertion of a wrench is formed in the head portion 91.

2.2 First Adapter

Figure 8B:
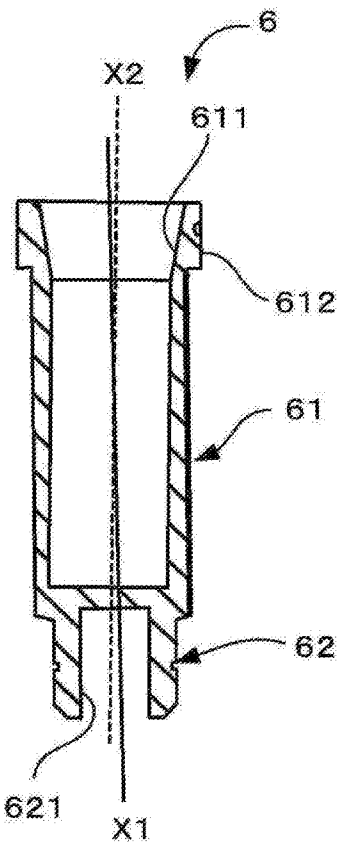
FIG. 8B is a cross-sectional view of the first adapter.
Figure 8A:
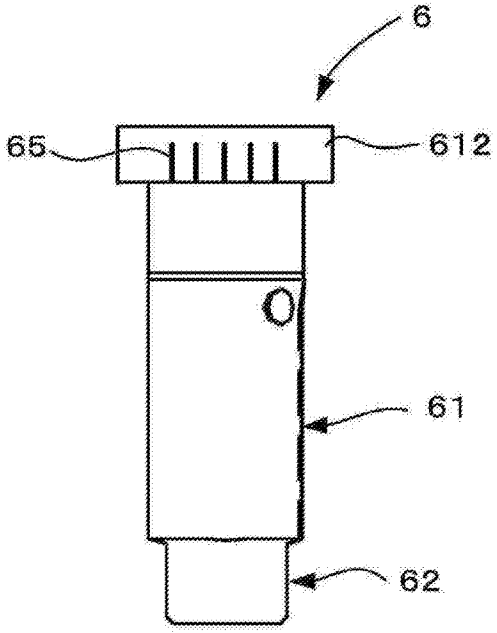
FIG. 8A is a side view of a first adapter.

Next, the first adapter 6 will be described with reference to FIG. 8. FIG. 8A is a side view of the first adapter, and FIG.

8B is a cross-sectional view of FIG. 8A. As shown in these figures, the first adapter 6 includes a body portion 61 formed with a tubular shape, a flange portion 612 that projects radially outward is formed on the upper end portion of the body portion 61, and a tubular coupling portion 62 having a smaller diameter than the body portion 61 is formed on the lower end portion of the body portion 61. These members are formed as a single body. The body portion 61 has a first axis X1 as its axial center, is externally shaped so as to extend along the first axis X1 in the shape of a cylinder, and has a shaft receiving recessed portion 611 that is open on the upper end side. This shaft receiving recessed portion 611 has a cylindrical inner wall surface that extends along a second axis X2 that intersects the first axis X1 at an angle of approximately 1 degree, and the lower end portion of the shaft 20 is inserted into this shaft receiving recessed portion 611. The shaft 20 is fixed to the shaft receiving recessed portion 611 by adhesion or the like. Accordingly, the shaft 20 is fixed such that the axial center S (see FIG. 1) thereof extends along the second axis X2 of the first adapter 6 and extends with an inclination from the first adapter 6.

The outer diameter of the body portion 61 of the first adapter 6 is smaller than the attachment hole 51 of the hosel portion 5, but the above-described flange portion 612 has a larger diameter than that of the attachment hole 51, and comes into contact with the upper surface of the later-described second adapter 7. Accordingly, the flange portion 612 of the first adapter 6 is arranged outside the attachment hole 51, and the portion of the first adapter 6 below the flange portion 612 is arranged in the interior space 50 of the hosel portion 5. Also, by, for example, providing multiple rotation position indicators 65 on the outer peripheral surface of the flange portion 612 as shown in the example in FIG. 8A, an angle can be set according to the user's preference, as will be described later, by aligning one of the rotation position indicators 65 with a reference indicator 75 provided on the second adapter 7.

The coupling portion 62 of the first adapter 6 is formed as a tube that extends along the first axis X1, and also has a threaded hole 621 that is open downward, and female threading is formed in this threaded hole 621. Note that the upper end portion of the first adapter 6 in FIG. 8 corresponds to a first end portion of the present invention, and the lower end portion of the first adapter 6 corresponds to a second end portion of the present invention.

2.3 Second Adapter

Figure 9A:
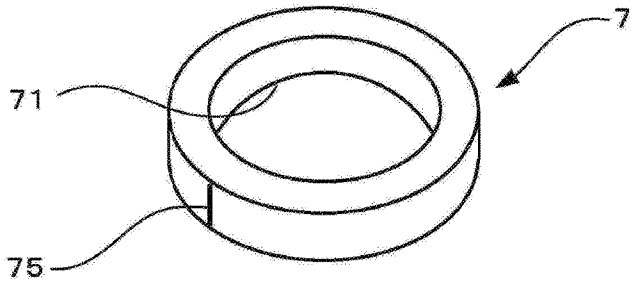
FIG. 9A is a perspective view of a second adapter as viewed from above.
Figure 9B:
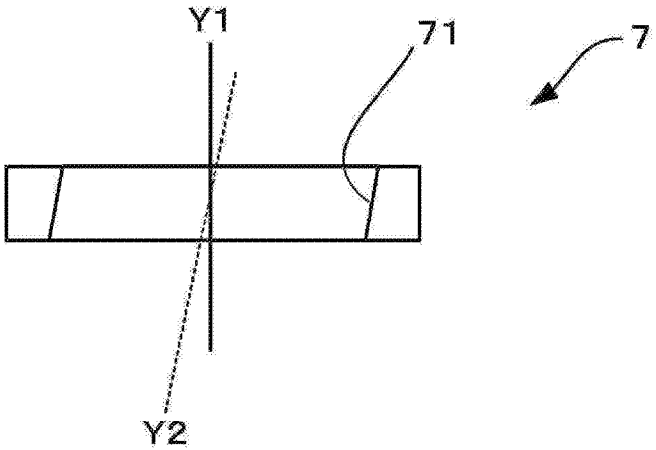
FIG. 9B is a cross-sectional view of the second adapter.

Next, the second adapter 7 will be described with reference to FIG. 9. FIG. 9A is a perspective view of the second adapter as viewed from above, and FIG. 9B is a cross-sectional view of the second adapter. As shown in these figures, the second adapter 7 is formed with the shape of a ring that has a through-hole 71, and is attached to the upper portion of the attachment hole 51 of the hosel portion 5. Also, the second adapter 7 is formed with approximately the same diameter as the attachment hole 51 of the hosel portion 5 and the flange portion 612 of the first adapter 6. Note that the upper end portion of the second adapter 7 in FIG. 9B corresponds to a first end portion of the present invention, and the lower end portion of the second adapter 7 corresponds to a second end portion of the present invention.

The second adapter has a first axis Y1 as its axial center, and is externally shaped so as to extend along the first axis Y1 in the shape of a cylinder. The through-hole 71 of the second adapter 7 has a cylindrical inner wall surface that extends along a second axis Y2 that intersects the first axis Y1 at an angle of approximately 1 degree, and the first adapter 6 is removably inserted into this through-hole 71. The inner diameter of this through-hole 71 is approximately the same as the outer diameter of the body portion 61 of the first adapter 6. The flange portion 612 of the inserted first adapter 6 comes into contact with the upper surface of the second adapter 7 as described above. In other words, the first adapter 6 and the second adapter 7 are coupled in a state of being capable of rotation. Accordingly, the rotation position of the first adapter 6 relative to the second adapter 7 can be changed to any rotation position. Note that a configuration is preferable in which the lower surface of the flange portion 612 and the upper surface of the second adapter 7 do not completely come into surface contact with each other. This is because in the case where these two surfaces are to completely come into contact in a surface contact mode, it can be required for the two surfaces to be distorted a certain amount or more in the relative rotation of these two adapters, and the relative rotation of these two adapters would be somewhat hindered. In this way, the inserted first adapter 6 extends along the second axis Y2 of the second adapter 7, and is thus fixed so as to extend with an inclination from the second adapter 7. Also, in this configuration, the second axis X2 of the first adapter 6 and the second axis Y2 of the second adapter 7 intersect each other, rather than being parallel, when the two adapters 6 and 7 are coupled.

Also, the reference indicator 75 is provided on the outer peripheral surface of the second adapter 7, and is used for positioning with the above-described rotation position indicators 65 of the first adapter 6. Also, as described above, the reference indicator 75 is used for alignment with the rotation position indicators 52 provided on the attachment hole 51 of the hosel portion 5.

Note that the adapters 6 and 7 used in the coupling structure can be formed from various types of materials such as Ti (6-4Ti) or Al (Al7075).

3. Assembly of Shaft and Golf Club Head

Next, a method of assembling the golf club having the above configuration will be described. First, the second adapter 7 is attached to the attachment hole 51 of the hosel portion 5. At this time, a rotation position for the second adapter 7 is appropriately determined, and the second adapter 7 is arranged in the attachment hole 51 in the desired rotation position. Next, the first adapter 6 having the shaft 20 fixed thereto is inserted into the through-hole 71 of the second adapter 7. At this time, one of the rotation position indicators 65 on the first adapter 6 is aligned with the reference indicator 75 of the second adapter 7. Note that it is also possible to insert the first adapter 6 into the second adapter 7, align the two adapters 6 and 7, and then insert the body portion 61 of the first adapter 6 into the attachment hole 51.

Then, as shown in FIG. 5, the portion of the first adapter 6 below the flange portion 612 is inserted into the interior space 50, and the coupling portion 62 provided on the lower end portion of the first adapter 6 is fixed in the interior space 50. Specifically, the washer 8 is arranged on the projection portion 53 in the interior space 50 from below, and then the threaded portion 92 of the fastener 9 is screwed into the coupling portion 62 of the first adapter 6 from below. At this time, the head portion 91 of the fastener 9 engages with the projection portion 53, and thus the fastener 9 is held in the interior space 50. Also, due to the fastener 9 being screwed into the first adapter 6, the position of the first adapter 6 in the axial direction is fixed in the interior space 50. In this way, the shaft 20 and the head 10 are coupled as shown in FIGS. 1, 2, 4, and 5. At this time, by firmly screwing the fastener 9, the first adapter 6 is fixed in the hosel portion 5 so as to not rotate. Accordingly, the flange portion 612 of the first adapter 6 pushes the second adapter 7 toward the attachment hole 51, and thus the second adapter 7 is sandwiched between the flange portion 612 and the attachment hole 51, and is held so as to not rotate.

When the shaft 20 and the head 10 have been fixed as described above, the shaft 20 is fixed so as to be inclined at an angle of 1 degree relative to the first adapter 6. Also, the first adapter 6 is fixed so as to be inclined at an angle of 1 degree relative to the second adapter 7. Accordingly, the shaft 20 is fixed so as to be inclined at a maximum of 2 degrees relative to the second adapter 7. In this way, the first adapter 6 is fixed so as to be inclined relative to the second adapter 7 and the attachment hole 51 of the hosel portion 5 in one of the rotation positions, and since the interior space accommodating the first adapter 6 is tapered, the first adapter 6 does not interfere with the inner wall surface of the interior space regardless of the rotation position in which the first adapter 6 is fixed to the second adapter 7.

Here, by changing the rotation position of the first adapter 6 relative to the second adapter 7 while keeping the rotation position of the second adapter 7 relative to the attachment hole 51 fixed, the attachment angle of the shaft 20 relative to the head 10 is changed, thus making it possible to change the lie angle, the loft angle, and the face angle of the head 10. Also, the lie angle, loft angle, and face angle can be changed more finely by changing the rotation angle of the second adapter 7 relative to the attachment hole 51.

At this time, the flange portion 612 of the first adapter 6 and the second adapter 7 are exposed to the outside, and thus the rotation position indicators 65 of the first adapter 6, the reference indicator 75 of the second adapter 7, and the rotation position indicators 52 of the hosel portion 5 can be viewed from the outside. Accordingly, the user can easily view the rotation positions of the first adapter 6 and the second adapter 7. For this reason, the user can check the rotation position of the first adapter 6 and the rotation position of the second adapter 7 and thus check the lie angle, the loft angle, and the face angle of the golf club, without disassembling the coupling structure.

4. Variations

Although an embodiment of the present invention has been described above, the present invention is not limited to this embodiment, and various modifications can be made without departing from the gist of the invention. The following are examples of modifications that can be made.

4.1

In the above embodiment, the first adapter 6 is fixed in the interior space 50 of the hosel portion 5 by the fastener 9 that is engaged with the projection portion 53 of the hosel portion 5. In other words, by firmly screwing the fastener 9, rotation of the first adapter 6 in the interior space 50 is prevented. Accordingly, the rotation position of the first adapter 6 relative to the second adapter 7 can be changed in a stepless manner. In the present invention, there are no particular limitations on the configuration as long as the first adapter 6 is fixed so as to be incapable of rotation in the interior space 50 of the hosel portion 5, and for example, the first adapter 6 can be fixed in the interior space 50 with the mechanism shown in FIGS. 10 to 12.

Figure 10:
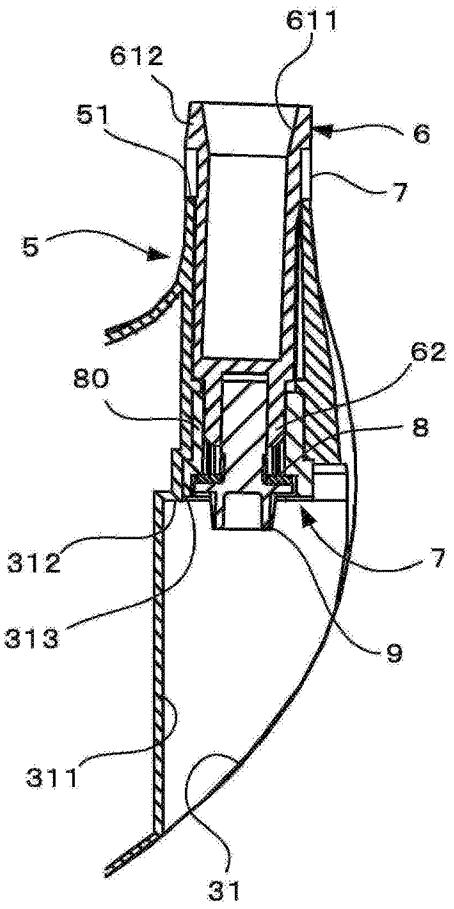
FIG. 10 is a cross-sectional view of another example of the golf club head.
Figure 11:
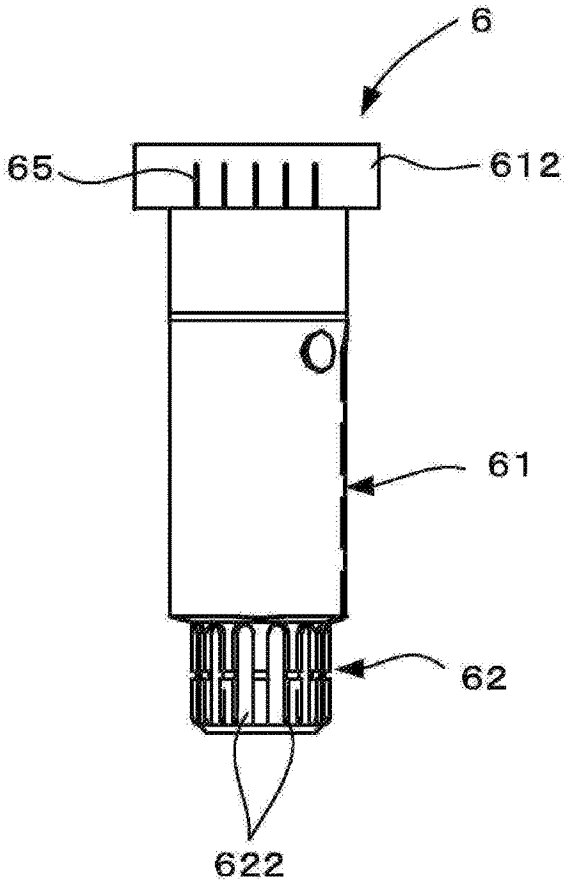
FIG. 11 is a side view of another example of the first adapter.
Figure 12A:
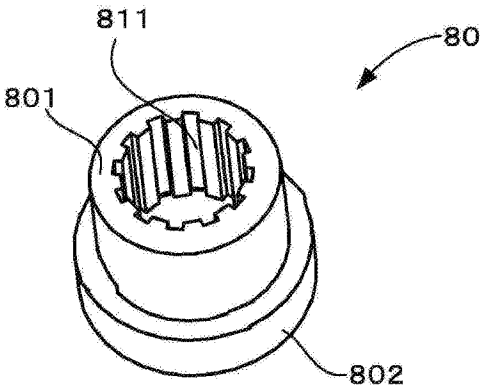
FIG. 12A is a perspective view of a fixing adapter.
Figure 12B:
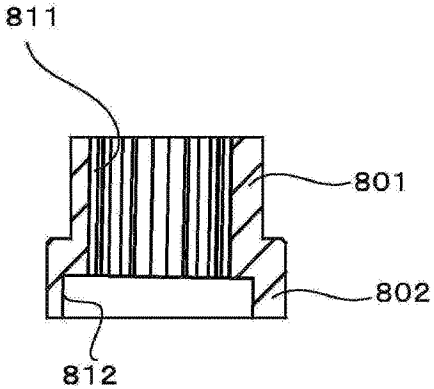
FIG. 12B is a cross-sectional view of the fixing adapter.

As shown in FIG. 10, in this example, a fixing adapter 80 is attached by welding or the like in the interior space 50 of the hosel portion 5 so as to be incapable of rotation, and the first adapter 6 is fixed to the fixing adapter 80. For this reason, as shown in FIG. 11, multiple projections 622 that extend along the first axis X1 are formed on the coupling portion 62 of the first adapter 6. On the other hand, as shown in FIG. 12, the fixing adapter 80 has a structure in which a small-diameter portion 801 and a large-diameter portion 802, which are shaped as circular columns, are coupled in an integrated manner. A circular through-hole 811 is formed in the small-diameter portion 801, and multiple grooves for insertion of the projection are formed in the inner wall surface of the through-hole 811. Also, a through-hole 812 is formed in the large-diameter portion 802 as well, and is in communication with the through-hole 811 of the small-diameter portion 801. The through-hole 812 of the large-diameter portion 802 has a larger diameter than the through-hole 811 of the small-diameter portion 801, and the above-described washer 8 is arranged on the step between the two through-holes 811 and 812. Also, the through-hole 811 of the small-diameter portion 801 of the fixing adapter 80 is inclined so as to accommodate the inclination of the first adapter 6.

As shown in FIG. 10, the coupling portion 62 of the first adapter 6 is inserted into the through-hole 811 of the small-diameter portion 801 of the fixing adapter 80, and these two members are splined together. Specifically, the first adapter 6 is inserted into the fixing adapter 80 at a predetermined rotation angle. The fastener 9 inserted into the through-hole 812 of the large-diameter portion 802 of the fixing adapter 80 is then screwed into the coupling portion 62 of the first adapter 6, thus fixing the first adapter 6 in the interior space 50.

According to this configuration, the first adapter 6 is fixed in the interior space 50 at a multiple rotation angles that have been determined in advance. Also, due to the coupling portion 62 of the first adapter 6 and the through-hole 811 of the fixing adapter 80 being splined together, the first adapter 6 is fixed in the interior space 50 so as to be incapable of rotation. Note that although the fixing adapter 80 is separate from the hosel portion 5 and is fixed by welding or the like in the interior space 50 so as to be incapable of rotation in this example, these two members may be formed as a single body. Also, there are no particular limitations on the configuration as long as the first adapter 6 is fixed in the interior space 50 so as to be incapable of rotation.

4.2

Although the second adapter 7 can rotate relative to the attachment hole 51 in the above embodiment, the second adapter 7 may be coupled with the attachment hole 51 so as to be incapable of rotation, for example. In this case, a protrusion portion is provided on the second adapter 7, and a recessed portion that receives the protrusion portion is provided in the attachment hole 51. Alternatively, conversely, a recessed portion may be provided in the second adapter 7, and a protrusion portion may be provided on the attachment hole 51.

4.3

In the above embodiment, the shaft 20 is inclined at an angle of 1 degree relative to the first adapter 6, and the first adapter 6 is inclined at an angle of 1 degree relative to the second adapter 7, but there are no particular limitations on these angles. Also, the two angles may be different.

4.4

Figure 13A:
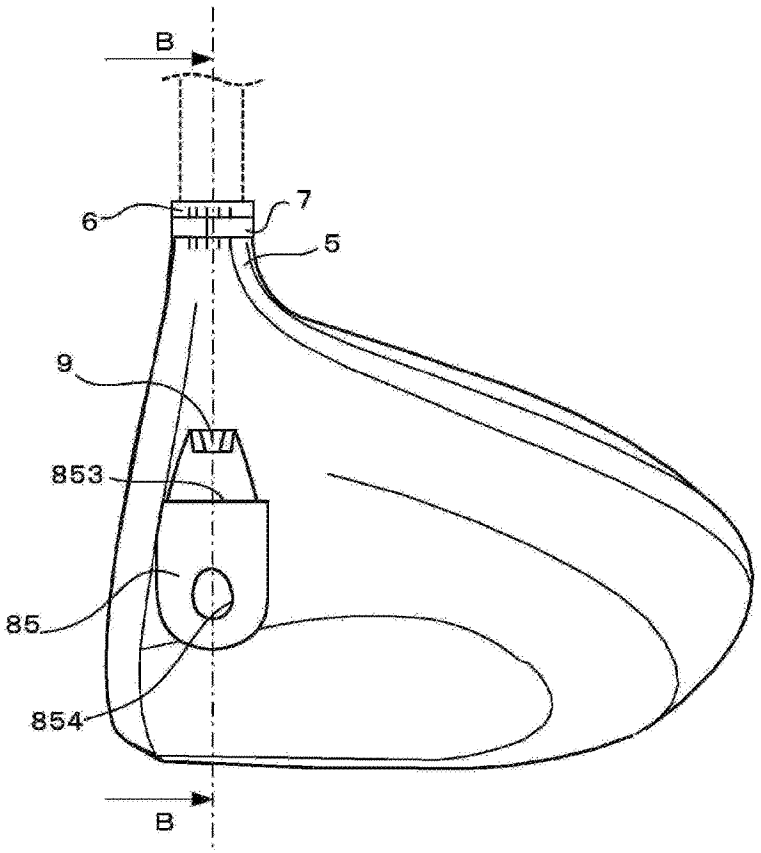
FIG. 13A is a front view of another example of the golf club head in FIG. 4.
Figure 13B:
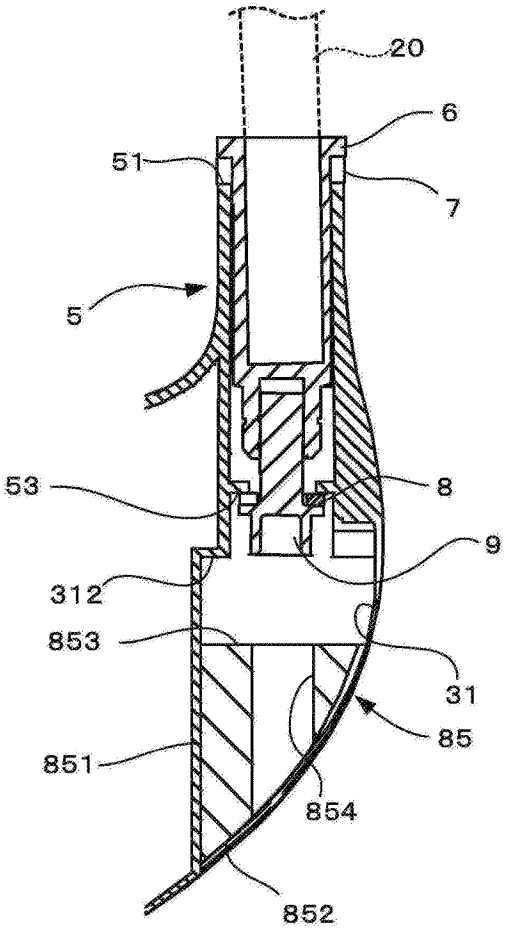
FIG. 13B is a cross-sectional view taken along line B-B in FIG. 13A.

Although the lower opening 313 in communication with the interior space faces to the recessed portion 31 formed in the surface of the golf club head 10 in the above embodiment, a cap for blocking the recessed portion 31 may be provided. For example, as shown in FIGS. 13A and 13B, a cap 85 is formed by a side wall surface 851 that extends along the side surface 311 of the recessed portion 31, an outer wall surface 852 that extends along the outer peripheral surface of the golf club head 10, and an end surface 853 that opposes the base surface 312 of the recessed portion 31.

The length of the side wall surface 851 in the axial direction is shorter than that of the side surface 311 of the recessed portion 31, and thus a gap is formed between the base surface 312 of the recessed portion 31 and the end surface 853. Also, a through-hole 854 that extends in the axial direction is formed between the outer wall surface 852 and the end surface 853, and a tool such as a wrench can be inserted through this through-hole 54 from outside the cap 85. It is then possible to engage the tool with the head portion 91 of the fastener 9 and detach the fastener 9 while the cap 85 is closed. According to this configuration, the recessed portion 31 is blocked by the cap 85, thus making it possible to improve the designability of the head 10 and prevent loss of the fastener 9 when it is detached.

4.5

Also, although the rotation position indicators 52 and 65 and the reference indicator 75 of the first adapter 6, the second adapter 7, and the attachment hole 51 are provided by lines, they can alternatively be provided by graphics, numbers, or the like, and it is alternatively possible to process portions of the adapters 6 and 7. For example, portions of the adapters can be cut out, or protruding portions can be provided thereon. Also, there is no particular distinction between the rotation position indicator and the reference position, and there are no particular limitations on them as long as rotation position alignment can be performed. In other words, it is sufficient that some sort of indicator is provided, and it is possible to provide the reference position on the first adapter 6.

4.6

Although a portion of the head 10 forms the interior space 50 in the hosel portion 5 in the above embodiment, the hosel portion 5 may be constituted by being attached to the golf club head as a separate body as shown in FIG. 7, for example.

4.7

Figure 14:
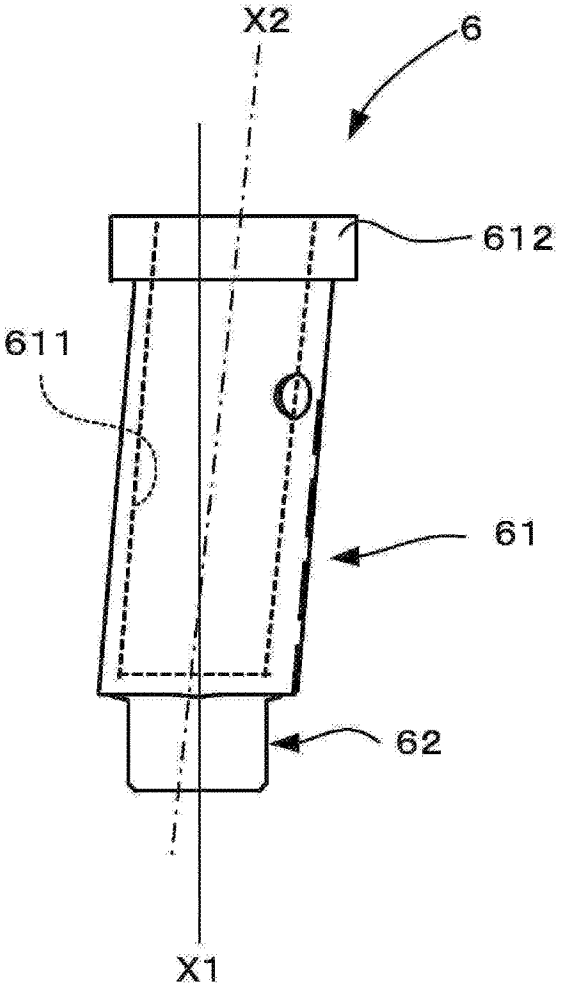
FIG. 14 is a side view of another example of the first adapter.

In the above embodiment, the outer peripheral surface of the first adapter 6 is formed so as to extend parallel to the first axis X1, and the shaft receiving recessed portion 611 is formed so as to extend along the second axis X2 that intersects the first axis X1, but the first adapter 6 can be formed as shown in FIG. 14, for example. As shown in this figure, in this example, the body portion 61 of the first adapter 6 is inclined relative to the coupling portion 62. Specifically, the coupling portion 62 is formed so as to extend along the first axis X1, and the outer peripheral surface of the body portion 61 is formed so as to extend along the second axis X2. Also, the shaft receiving recessed portion 611 formed in the body portion 61 is also formed so as to extend along the second axis X2. According to this configuration as well, the axis of the shaft 20 extends along the second axis X2, and therefore the shaft 20 can be fixed so as to be inclined relative to the first adapter 6. Note that in order for the entirety of the flange portion 612 to come into contact with the second adapter 7, the flange portion 612 is formed so as to be inclined relative to the body portion 61.

4.8

Figure 15:
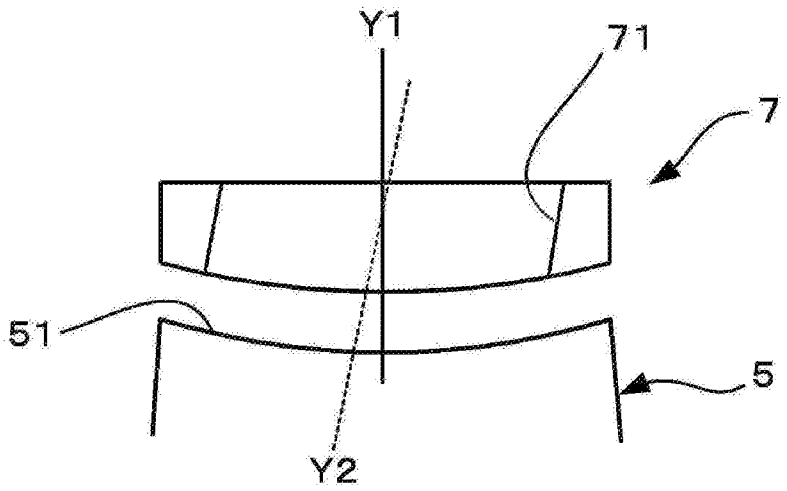
FIG. 15 is a cross-sectional view of another example of the second adapter and the attachment hole.

Also, as shown in FIG. 15, the lower end portion of the second adapter 7 can be formed in the shape of a spherical surface that protrudes downward. In this case, the peripheral edge of the attachment hole 51 of the hosel portion 5 can be formed as a recessed portion with a spherical surface shape so as to conform to the second adapter 7. Accordingly, the second adapter 7 can come into contact with the attachment hole 51 at various angles.

4.9

Note that since the golf club head configured as described above is a hollow structure, it can be manufactured by joining two or more members together. Specifically, it can be manufactured by joining together a head body provided with one or two or more openings in communication with a hollow portion, and a separate member that blocks these openings. For example, it is possible to constitute the head by constituting only the crown portion 2 and the face portion 1 as separate members and combining them with the head body, or forming the head body such that an opening is provided in the sole portion 3 and the side portion 4 and blocking this opening with a separate member. Also, this head body can be manufactured by casting using a known lost-wax precision casting method, for example.

REFERENCE SIGNS LIST

10 Golf club head
20 Shaft
31 Lower opening
5 Hosel portion
51 Attachment hole
6 First adapter
612 Flange portion
7 Second adapter
8 Washer (fixing member)
9 Fastener (fixing member)

The invention claimed is:

1. A golf club comprising:

a shaft;

a golf club head having a hosel portion and an opening portion that is formed on a side opposite to the hosel portion and is in communication with an interior space of the hosel portion, the interior space being open at a shaft attachment hole of the hosel portion;

a first adapter that has a first end portion and a second end portion, the first adapter having a shaft receiving recessed portion to which the shaft is to be fixed and that is open on a side of the first end portion, and a coupling portion on the first end portion, and the second end portion being accommodated in the interior space of the hosel portion through the attachment hole;

a second adapter that has a first end portion and a second end portion, a through-hole through which the first adapter passes being formed in the second adapter, and at least a portion of the second adapter being arranged outside the attachment hole; and a fixing member that detachably fixes the first adapter in the interior space of the hosel portion, wherein the shaft is configured to be coupled with an inclination relative to the coupling portion of the first adapter, the first adapter is configured to be coupled with an inclination relative to the second adapter, the coupling portion of the first adapter and the first end portion of the second adapter are coupled so as to be capable of axial rotation, and the first adapter is fixed in the interior space of the hosel portion so as to be incapable of rotation, wherein the first adapter has the first end portion and the second end portion at respective ends along a first axis and is formed with a tubular shape along the first axis, and the shaft receiving recessed portion extends along a second axis that intersects the first axis, and the second adapter has the first end portion and the second end portion at respective ends along a first axis and is formed with a tubular shape along the first axis, and the through-hole is formed along a second axis that intersects the first axis.

2. The golf club according to claim 1, wherein the second adapter is formed with a ring shape, and is arranged adjacent the attachment hole such that at least a portion of the second adapter is exposed to the outside.

3. The golf club according to claim 2, wherein the coupling portion of the first adapter is formed by a flange portion that projects radially outward, and the flange portion is coupled to the first end portion of the second adapter.

4. The golf club according to claim 2, further comprising a fixing adapter that couples the first adapter in the interior space of the hosel portion so as to be incapable of rotation.

5. The golf club according to claim 4, wherein the fixing adapter and the first adapter are splined together.

6. The golf club according to claim 2, wherein an indicator indicating a rotation position is provided on at least two out of the first adapter, the second adapter, and the hosel portion.

7. The golf club according to claim 1, wherein the coupling portion of the first adapter is formed by a flange portion that projects radially outward, and the flange portion is coupled to the first end portion of the second adapter.

8. The golf club according to claim 7, further comprising a fixing adapter that couples the first adapter in the interior space of the hosel portion so as to be incapable of rotation.

9. The golf club according to claim 7, wherein an indicator indicating a rotation position is provided on at least two out of the first adapter, the second adapter, and the attachment hole.

10. The golf club according to claim 1, further comprising a fixing adapter that couples the first adapter in the interior space of the hosel portion so as to be incapable of rotation.

11. The golf club according to claim 10, wherein the fixing adapter and the first adapter are splined together.

12. The golf club according to claim 11, wherein an indicator indicating a rotation position is provided on at least two out of the first adapter, the second adapter, and the hosel portion.

13. The golf club according to claim 10, wherein an indicator indicating a rotation position is provided on at least two out of the first adapter, the second adapter, and the hosel portion.

14. The golf club according to claim 1, wherein an indicator indicating a rotation position is provided on at least two out of the first adapter, the second adapter, and the hosel portion.

* * * * *